US008676098B2

(12) United States Patent
Hirokawa et al.

(10) Patent No.: US 8,676,098 B2
(45) Date of Patent: Mar. 18, 2014

(54) DEVELOPING DEVICE AND IMAGE FORMING APPARATUS

(75) Inventors: Kazuhiko Hirokawa, Ebina (JP); Kunihiko Sato, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 273 days.

(21) Appl. No.: 13/191,082

(22) Filed: Jul. 26, 2011

(65) Prior Publication Data

US 2012/0195648 A1 Aug. 2, 2012

(30) Foreign Application Priority Data

Feb. 1, 2011 (JP) ..... 2011-020080

(51) Int. Cl.
*G03G 15/09* (2006.01)

(52) U.S. Cl.
USPC ..... 399/272; 399/120; 399/107

(58) Field of Classification Search
USPC ..... 399/272, 120, 107
See application file for complete search history.

(56) References Cited

U.S. PATENT DOCUMENTS

2009/0220266 A1 * 9/2009 Shiraishi et al. ..... 399/58

FOREIGN PATENT DOCUMENTS

| | | | |
|---|---|---|---|
| JP | 10-186829 | A | 7/1998 |
| JP | 2005-234483 | A | 9/2005 |
| JP | 2005-292511 | A | 10/2005 |
| JP | 2007-293142 | A | 11/2007 |

* cited by examiner

*Primary Examiner* — Walter L Lindsay, Jr.
*Assistant Examiner* — Roy Y Yi
(74) *Attorney, Agent, or Firm* — Sughrue Mion, PLLC

(57) ABSTRACT

A developing device includes a developer carrier that holds a developer on a surface thereof, rotates around a rotation axis, and supplies the developer to an image carrier at a facing portion at which the developer carrier faces the image carrier; a transport member that transports the developer in a transport direction along the rotation axis while supplying the developer to the surface of the developer carrier; and a guide member that includes a guide portion that guides, toward downstream in the transport direction, the developer that has passed the facing portion without being supplied to the image carrier, the guide member making an amount of the developer that reaches the transport member on an upstream side of the guide portion in the transport direction be smaller than an amount of the developer that reaches the transport member in on a downstream side of the guide portion.

10 Claims, 11 Drawing Sheets

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2011-020080 filed Feb. 1, 2011.

BACKGROUND

Technical Field

The present invention relates to a developing device and an image forming apparatus.

SUMMARY

According to an aspect of the present invention, a developing device includes a developer carrier that holds a developer on a surface thereof, rotates around a rotation axis, and supplies the developer to an image carrier at a facing portion at which the developer carrier faces the image carrier; a transport member that transports the developer in a transport direction along the rotation axis of the developer carrier while supplying the developer to the surface of the developer carrier; and a guide member that includes a guide portion that guides, toward downstream in the transport direction, the developer that was held on the surface of the developer carrier and that has passed the facing portion without being supplied to the image carrier, the guide member making an amount of the developer that reaches the transport member from the developer carrier on an upstream side of the guide portion in the transport direction be smaller than an amount of the developer that reaches the transport member from the developer carrier on a downstream side of the guide portion in the transport direction.

BRIEF DESCRIPTION OF THE DRAWINGS

Exemplary embodiments of the present invention will be described in detail based on the following figures, wherein.

DETAILED DESCRIPTION

First Exemplary Embodiment

Hereinafter, a first exemplary embodiment of the present invention will be described with reference to the drawings.

Figure 1:
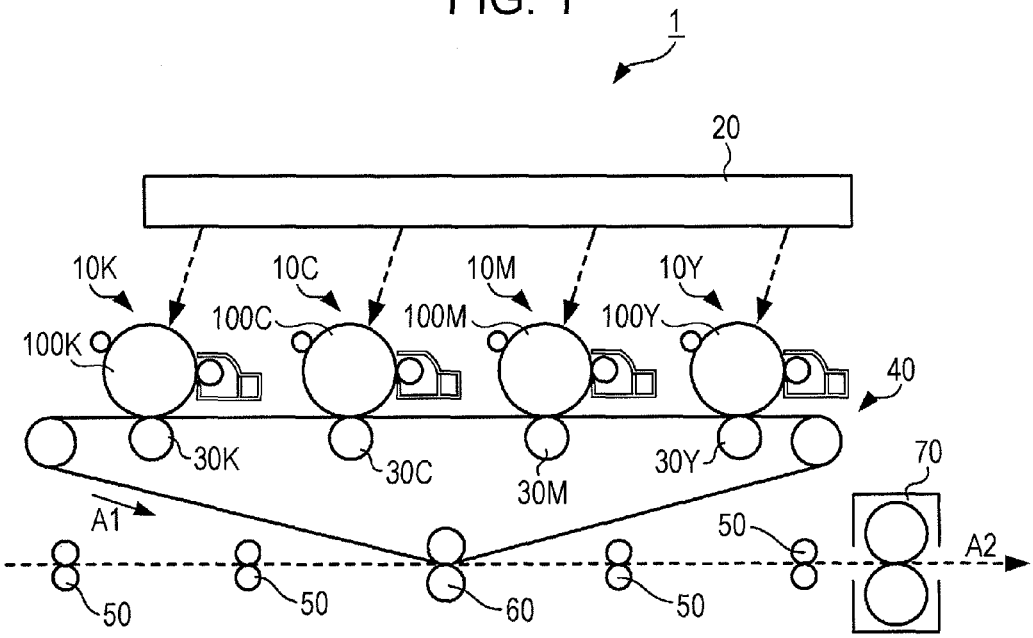
FIG. 1 illustrates the structure of an image forming apparatus according to a first exemplary embodiment.

FIG. 1 illustrates the structure of an image forming apparatus 1 according to the first exemplary embodiment of the present invention. The image forming apparatus 1 is an electrophotographic printer that forms an image on a sheet, which is an example of a recording medium. In the present exemplary embodiment, the image forming apparatus 1 forms a color image by using yellow (Y), magenta (M), cyan (c), and black (K) toners. First, the overall structure of the image forming apparatus 1 will be described.

The image forming apparatus 1 includes photoconductor units 10Y, 10M, 10C, and 10K; an exposure unit 20; first transfer rollers 30Y, 30M, 30C, and 30K; an intermediate transfer unit 40; plural transport rollers 50; a second transfer unit 60; and a fixing unit 70. The photoconductor unit 10Y includes a photoconductor drum 100Y, and the photoconductor unit 10M includes a photoconductor drum 100M. The photoconductor unit 10C includes a photoconductor drum 100C, and the photoconductor unit 10K includes a photoconductor drum 100K. The intermediate transfer unit 40 includes an intermediate transfer belt and rotary rollers, and the second transfer unit 60 includes a second transfer roller and a backup roller. The components of the image forming apparatus 1 indicated by numerals with a suffix Y, M, C, or K is related to image forming using a color corresponding to the suffix. The components indicated by the same numeral and different suffixes have the same structure except that they differ in the positions thereof and the toners used. When it is not necessary to discriminate between such components, the suffix will be omitted in the description.

The photoconductor drum 100 includes a cylindrical member (roller) having multilayered photoconductive films on a surface thereof. The photoconductor drum 100 is rotated around the rotation axis of the roller. The exposure unit 20, which is a light irradiation device, irradiates (exposes) the surface of the photoconductor drum 100 with a light beam while controlling the intensity and irradiation position of the light beam. The exposure unit 20 is an example of an "exposure device". The photoconductor drum 100 holds an electrostatic latent image that is formed thereon in accordance with the light beam (exposure light beam), with which the exposure unit 20 irradiates the photoconductor drum 100. The photoconductor unit 10 supplies a developer including a toner to the surface of the photoconductor drum 100, and develops the electrostatic latent image. To be specific, the developer adheres to a part of the surface of the photoconductor drum 100 on which the electrostatic latent image is formed, thereby forming a toner image. The photoconductor drum 100 is an example of an "image carrier", and the toner image is an example of an "image". The photoconductor unit 10 and the exposure unit 20 cooperate and function as an "image forming unit". The intermediate transfer belt, which is an endless belt, rotates in the direction of arrow A1 while being in contact with the rotary rollers, the first transfer roller 30, and the backup roller. The rotary rollers are cylindrical members that rotate around the axes thereof and that support the movement of the intermediate transfer belt.

The first transfer roller 30 faces the photoconductor drum 100 with the intermediate transfer belt therebetween. The first transfer roller 30 generates a potential difference in a first transfer region between the first transfer roller 30 and the photoconductor drum 100, and transfers the toner image formed on the surface of the photoconductor drum 100 to a surface of the intermediate transfer belt.

The second transfer roller faces the backup roller with the intermediate transfer belt therebetween. The second transfer roller generates a potential difference in a transfer region between the backup roller and the second transfer roller, and transfers the toner image on the surface of the intermediate transfer belt to a surface of a sheet (recording medium). The first transfer roller 30, the intermediate transfer unit 40, and the second transfer unit 60 cooperate and function as a "transfer unit". The transport rollers 50 transport the sheet to a position at which the second transfer unit 60 performs transfer, and transports the sheet, to which the toner image has been transferred, to a position at which the fixing unit 70 is disposed. The fixing unit 70 heats and presses the sheet, to which the toner image has been transferred, and fixes the toner image onto the sheet. The fixing unit 70 is an example of a "fixing unit". With the structure described above, the image forming apparatus 1 forms an image on a recording medium that is transported in the direction of arrow A2, which is illustrated by a broken line. Next, the structure of the photoconductor unit 10 will be described in detail.

Figure 2:
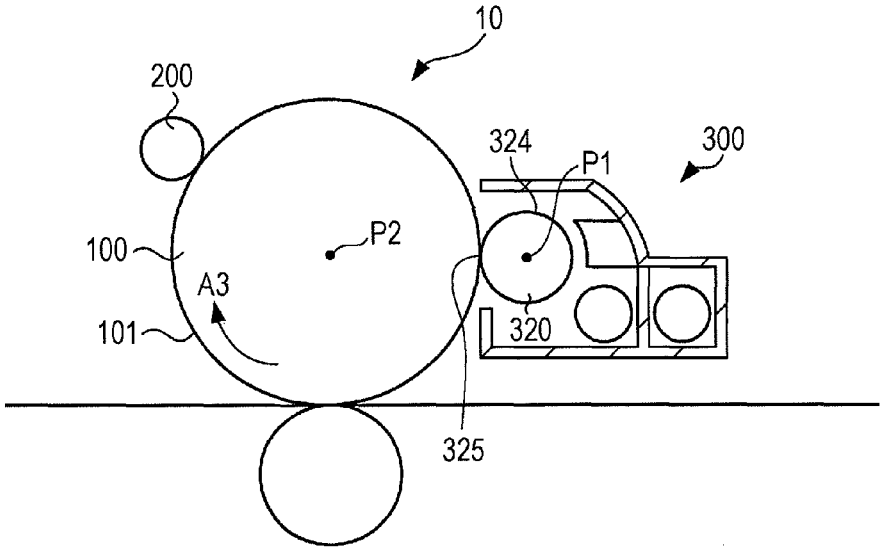
FIG. 2 illustrates the structure of a photoconductor unit.

FIG. 2 illustrates the structure of the photoconductor unit 10. The photoconductor unit 10 includes the photoconductor drum 100, a charger 200, and a developing device 300. The photoconductor drum 100 rotates in the direction of arrow A3 around the rotation axis P2. The charger 200 is disposed downstream of the first transfer region in the direction in which the photoconductor drum 100 rotates. The charger 200 charges a surface (photoconductive film) 101 of the photoconductor drum 100, from which a toner image has been transferred and on which a new toner image is to be formed, to a predetermined potential. The exposure unit 20 illustrated in FIG. 1 exposes the charged surface 101 to light, and forms an electrostatic latent image on the surface 101.

The developing device 300 is disposed adjacent to the photoconductor drum 100 at a position downstream of the charger 200 and upstream of the first transfer region in the direction in which the photoconductor drum 100 rotates. The developing device 300 includes a developing roller 320 that is disposed in a facing portion 325 at which the developing device 300 faces the photoconductor drum 100. The developing roller 320 has a roller that rotates around the rotation axis P1, which extends along the rotation axis P2. The developing roller 320 rotates while holding a developer on a surface 324 of the roller. The developing roller 320 supplies the developer, which is held on the surface 324, to the surface 101 in the facing portion 325, and thereby develops the electrostatic latent image. To be specific, the developing roller 320 generates a potential difference between the photoconductor drum 100 and the developing roller 320, and moves the charged toner to the surface 101 by using the potential difference. The toner, which has been moved to the surface 101, forms a toner image, and the toner image is transferred to the intermediate transfer belt, which is in contact with the surface 101 in the first transfer region. The developing roller 320 is an example of a "developer carrier". Next, referring to FIG. 3, the structure of the developing device 300 will be described in detail.

Figure 3:
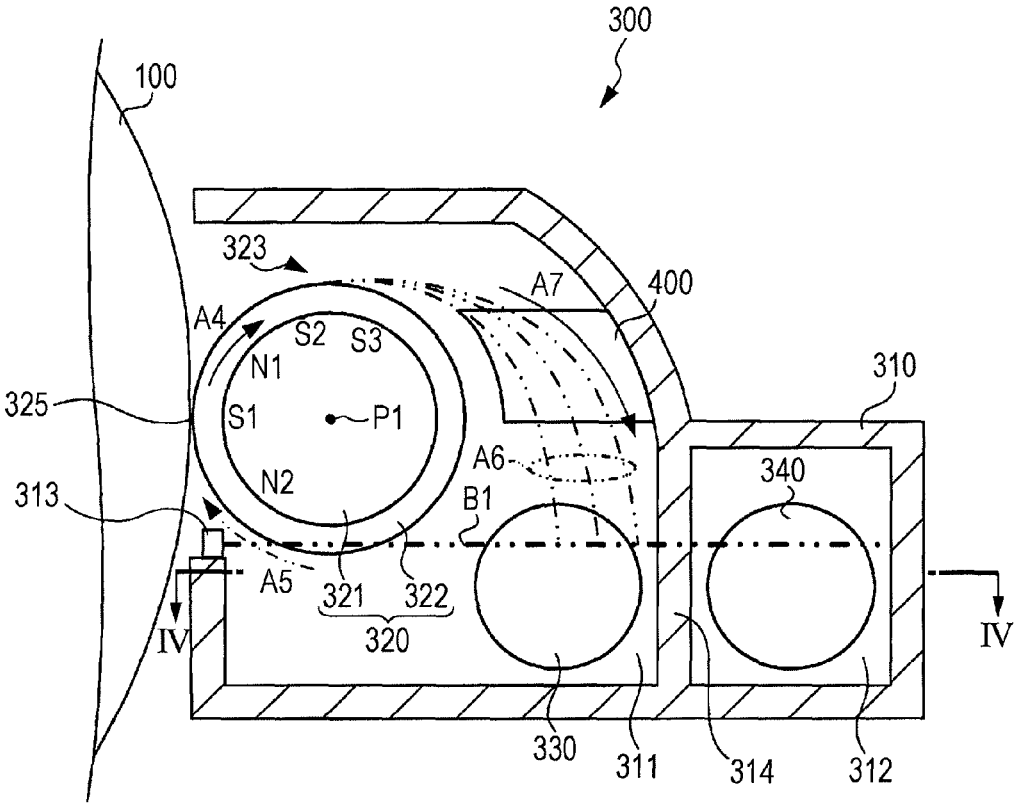
FIG. 3 illustrates the structure of a developing device.
Figure 4:
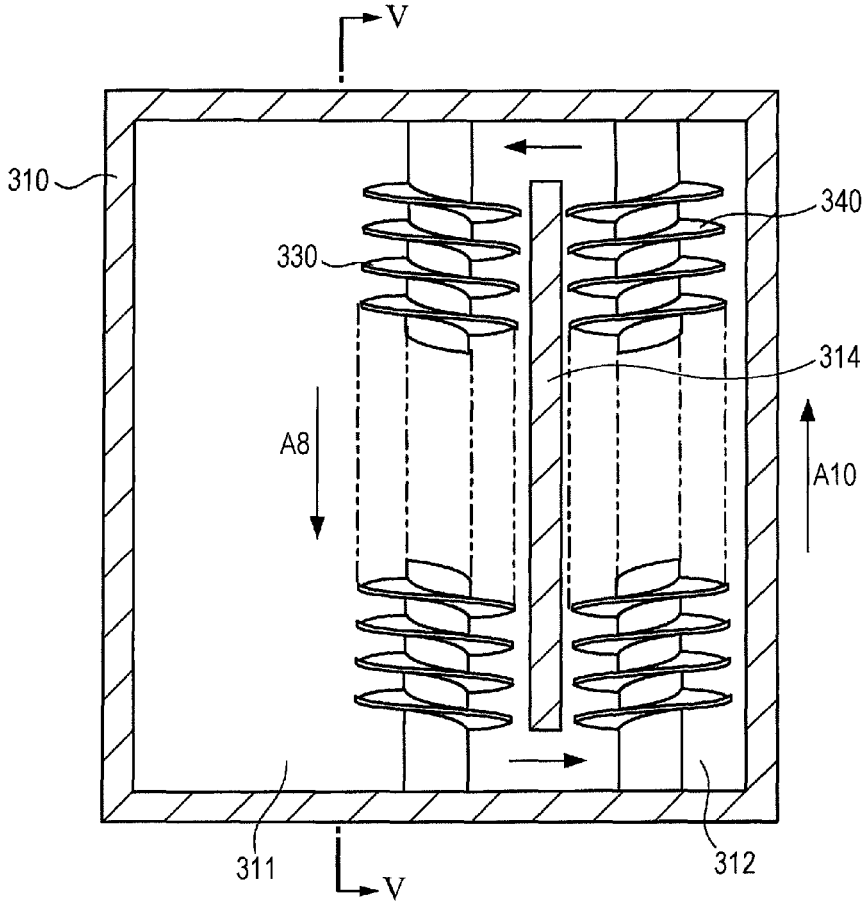
FIG. 4 illustrates how a developer is circulated in a housing.
Figure 5:
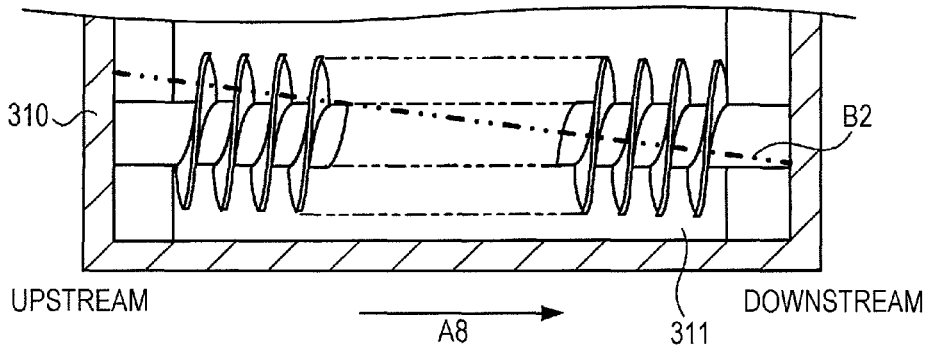
FIG. 5 illustrates a state of a surface of the developer in a first container.

FIG. 3 illustrates the structure of the developing device 300. The developing device 300 includes a housing 310, a developing roller 320, and a guide member 400. The housing 310 includes a first container 311 and a second container 312, which contain a nonmagnetic toner and a magnetic additive (magnetic carrier). In FIG. 3, a surface B1 that is formed by the developer contained in the first container 311 and the second container 312 is illustrated by a two-dot chain line. The first container 311 includes a first transport roller 330, and the second container 312 includes a second transport roller 340. The first container 311 is an example of a "container". The first transport roller 330 is an example of a "transport member". The developer contained in the first container 311 and the second container 312 is transported by the first transport roller 330 and the second transport roller 340, and is circulated in the housing 310. Referring to FIGS. 4 and 5, how the first transport roller 330 and the second transport roller 340 circulate the developer will be described.

FIG. 4 illustrates how the developer is circulated in the housing 310. FIG. 4 is a sectional view of the housing 310 taken along line IV-IV of FIG. 3. Each of the first transport roller 330 and the second transport roller 340 is supported by the housing 310 so as to be rotatable around the rotation axis thereof. Each of the first transport roller 330 and the second transport roller 340 has a spiral blade that rotates around a rotation axis, and transports the developer while agitating the developer. The first transport roller 330 transports the developer in the direction of arrow A8 (hereinafter referred to as a "first transport direction A8"). The second transport roller 340 transports the developer in the direction of arrow A10 (hereinafter referred to as a "second transport direction"). The first transport direction A8 and the second transport direction are parallel to the rotation axis P1 illustrated in FIG. 3. The first transport direction A8 is an example of a "transport direction". The first container 311 and the second container 312 serve as a path (transport path) along which the first transport roller 330 and the second transport roller 340 transport the developer. The transport path is divided into two sections by a wall 314 of the housing 310, and the two sections are connected to each other at end portions of the containers in the direction along the rotation axes of the transport rollers. When the developer is transported along one of the sections of the transport path and reaches an end portion of one of the containers, the developer is further transported to the other of the containers. Thus, the developer is circulated in the housing 310.

In the first container 311, the first transport roller 330 transports the developer in the first transport direction A8, and the developer is supplied to the surface of the developing roller 320 illustrated in FIG. 3. In other words, the first transport roller 330 transports the developer in the first transport direction A8 while supplying the developer to the surface of the developing roller 320. The developing roller 320 rotates around the rotation axis P1 illustrated in FIG. 3 while holding the developer that is contained in the first container 311 on the surface thereof, and supplies the developer to the photoconductor drum 100. At this time, because the developing roller 320 holds the supplied developer from the upstream side in the first transport direction A8, unevenness in the amount of the developer may occur in that the amount of the developer on the downstream side in the first transport direction A8 may be smaller than that on the upstream side. The unevenness increases as the rotation speed of the developing roller 320 increases and the amount of the developer that is held and transported by the developing roller 320 increases. The unevenness increases as the amount of developer retained in a connection portion between the first container 311 and the second container 312 increases. Unless otherwise noted, "upstream" and "downstream" will refer to those with respect to the first transport direction A8.

FIG. 5 illustrates a state of the surface of the developer in the first container 311. FIG. 5 is a sectional view of the housing 310 taken along line V-V of FIG. 4. A surface B2 of the developer contained in the first container 311 is illustrated by a two-dot chain line. FIG. 5 illustrates a state in which unevenness in the amount of developer has occurred in the first transport direction A8. To be specific, the amount of the developer decreases in the downstream direction. The thickness of the developer (the height of the surface B2 from the bottom surface of the housing 310) in the vertical direction decreases in the downstream direction. When the developer is in the state illustrated in FIG. 5, the amount of developer that the developing roller 320 illustrated in FIG. 3 supplies to the photoconductor drum 100 illustrated in FIG. 3 decreases in the downstream direction. As a result, unevenness in the density of the toner image formed on the surface of the photoconductor drum 100 occurs.

Referring back to FIG. 3, the housing 310 has an opening that is open toward the photoconductor drum 100. The developing roller 320 is exposed to the outside through the opening. The developing roller 320 includes a magnet roller 321 and a sleeve 322. The magnet roller 321 has five magnetic poles including north poles N1 and N2 and south poles S1, S2, and S3. These magnetic poles are arranged in the order of S1, N1, S2, S3, and N2 with predetermined distances therebetween in the circumferential direction. The magnetic pole S1 is disposed so as to face the photoconductor drum 100, and generates magnetic flux that is oriented such that the magnetic flux moves the developer toward the photoconductor drum 100. The magnetic pole N2 is disposed so as to face a restraining member 313 disposed on the housing 310, and generates magnetic flux that is oriented such that the magnetic flux moves the developer toward the restraining member 313. The restraining member 313 is disposed at a predetermined distance from the surface of the developing roller 320, and restrains the amount of developer that is transported in the direction of arrow A5. The magnetic pole S2 and the magnetic pole S3 are disposed downstream of the magnetic pole S1 in the direction in which the developing roller 320 rotates. Because the magnetic poles S2 and S3 having the same polarity are disposed adjacent to each other, the magnetic poles generate magnetic flux that is oriented such that the magnetic flux remove the developer from the developing roller 320. The magnetic pole N1 generates magnetic flux that is oriented such that the magnetic flux moves the developer from the magnetic pole S1 to the magnetic pole S2.

The sleeve 322 is an aluminum cylindrical member having V-shaped grooves formed in a surface thereof. The sleeve 322 is supported so as to be rotatable in the direction of arrow A4 around the rotation axis P2. The sleeve 322 holds the developer by attracting the developer to the surface thereof (i.e., the surface of the developing roller 320), and transports the developer. When the sleeve 322 passes magnetic pole N2, the restraining member 313 makes the amount (thickness) of the developer that is held and transported by the sleeve 322. The developer is supplied to the photoconductor drum 100 in the facing portion 325 that faces the photoconductor drum 100 (i.e., at a position of the magnetic pole S1). At this time, a nonmagnetic toner of the developer is mainly supplied. The developer that was held on the surface of the sleeve 322 and was not supplied to the photoconductor drum 100, which is mainly a magnetic carrier, passes the facing portion, and as the sleeve 322 rotates, is moved to a removal region 323 in which the magnetic poles S2 and S3 generate magnetic flux. The developer is removed from the surface of the sleeve 322 in the removal region 323.

The magnetic poles S2 and S3 are disposed at positions that are vertically above the developer contained in the first container 311 and that allow the removed developer to move (fall) toward the surface B1 of the developer contained in the first container 311 along a parabolic trajectory. The removed developer has kinetic energy in the direction in which the sleeve 322 rotates, and moves along a tangent line extending from the position from which the developer is removed. The higher the rotation speed of the sleeve 322, the farther from the developing roller 320 the developer moves. In FIG. 3, an imaginary parabola A6, which is illustrated by two-dot chain lines, is a trajectory of the developer when it is assumed that the guide member 400 is not present, and the arrow A7 indicates the direction in which the developer moves along the imaginary parabola A6. Hereinafter, the direction of arrow A7 will be referred to as a "movement direction A7". When the removed developer reaches the surface B1, the removed developer becomes mixed with the developer that forms the surface B1, becomes contained in the first container 311, and is transported by the first transport roller 330. Thus, the developer that has passed the facing portion 325 reaches the first transport roller 330, and is supplied to the developing roller 320 again. The developing roller 320 and the magnetic poles S2 and S3 are disposed so that the removed developer reaches the developer that is contained in the first container 311. The guide member 400 is disposed on the imaginary parabola A6, and guides, toward the downstream direction, the developer that reaches the guide member 400 while moving toward the surface B1. Next, referring to FIG. 6, the structure of the guide member 400 will be described in detail.

Figure 6:
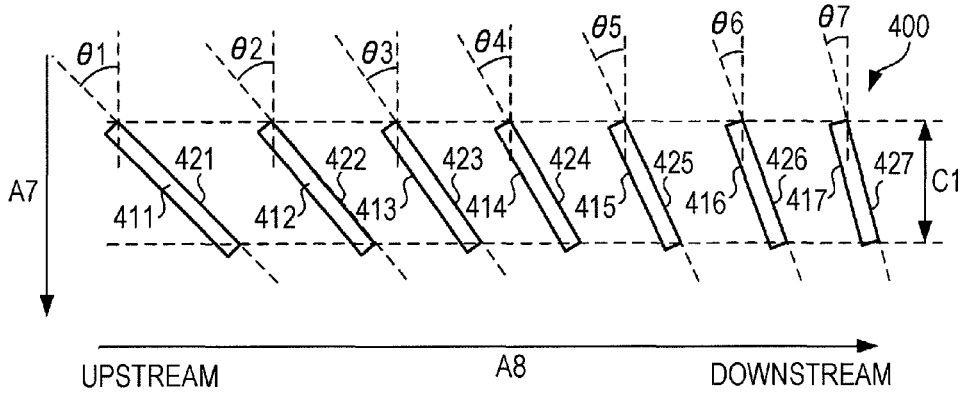
FIG. 6 illustrates a guide member when seen in a horizontal direction from a developing roller side.

FIG. 6 illustrates the guide member 400 illustrated in FIG. 3 when seen horizontally from the developing roller 320 side. In FIG. 6, the direction A7 is the vertical component of the movement direction A7 illustrated in FIG. 3, and the direction A8 is the same as the first transport direction A8 illustrated in FIG. 5. The guide member 400 includes plate-shaped members 411, 412, 413, 414, 415, 416, and 417 (which will be referred to as "plate-shaped members 410" when they are not distinguished from each other). The plate-shaped members 410 respectively have guide surfaces 421, 422, 423, 424, 425, 426, and 427 (which will be referred to as "guide surfaces 420" when they are not distinguished from each other) that guide the developer that is moving in the movement direction A7 when the developer reaches the guide surfaces 420. The guide surfaces 420 (i.e., the plate-shaped members 410) are arranged in the first transport direction A8. The length (height) of each of the guide surfaces 420 is C1.

Each of the guide surfaces 420 is inclined with respect to the vertical direction such that the lower end thereof in the vertical direction is located downstream, in the first transport direction A8, of the upper end thereof in the vertical direction. To be specific, when seen horizontally from the developing roller 320 side as illustrated in FIG. 6, the guide surfaces 420 respectively have angles θ1, θ2, θ3, θ4, θ5, θ6, and θ7 with respect to the vertical direction. The more upstream the position of the plate-shaped member 410, the larger the angle, i.e., $\theta 1>\theta 2>\theta 3>\theta 4>\theta 5>\theta 6>\theta 7$. That is, in the guide member 400, the more upstream the position of the guide surface 420, the larger the guide surface 420 is inclined toward downstream. The angles are larger than 0 degrees and smaller than 90 degrees. Due to such inclinations, the guide surfaces 420 of the plate-shaped members 410 block the imaginary parabola A6 illustrated in FIG. 3. That is, the guide surfaces 420 of the plate-shaped members 410 are disposed at positions such that the moving developer reaches the guide surfaces 420. The guide surfaces 420 apply downstream forces to the developer that reaches the guide surfaces 420, and guide the developer toward the downstream direction. The guide surfaces 420 are examples of a "guide portion" and a "plurality of surfaces".

Figure 7:
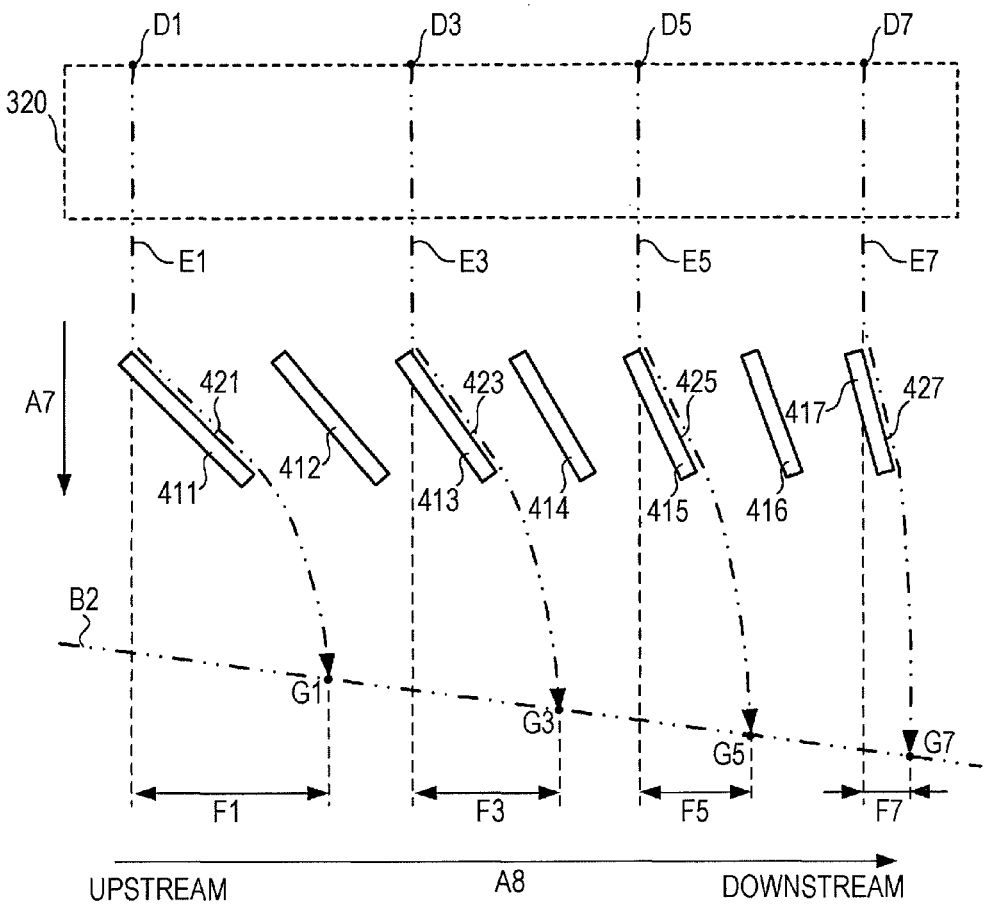
FIG. 7 illustrates examples of trajectories of the developer that is guided by a guide member.

FIG. 7 illustrates examples of trajectories of the developer that is guided by the plate-shaped members 410. In FIG. 7, the direction A7 is the vertical component of the movement direction A7 illustrated in FIG. 3, and the direction A8 is the same as the first transport direction A8 illustrated in FIG. 5. In FIG. 7, the developing roller 320 illustrated in FIG. 3 is schematically illustrated by a broken line. When the developer that has been removed from the developing roller 320 reaches the guide surfaces 420, the developer moves downstream along the guide surfaces 420. The developer has kinetic energy in the downstream direction when the developer is removed from the guide surface 420, so that the developer moves along a parabola oriented toward the downstream direction and reaches the surface B2. As a result, the developer reaches the positions of the surface B2 that are displaced downstream in the first transport direction A8 from the positions that the developer would have reached if the developer did not reach the guide surfaces 420, i.e., the positions from which the developer was removed from the developing roller 320 as illustrated in FIG. 3.

In FIG. 7, the trajectories of parts of the developer that have reached the upper ends of the guide surfaces 421, 423, 425, and 427 in the vertical direction are illustrated by two-dot chain lines E1, E3, E5, and E7. In FIG. 7, first positions D1, D3, D5, and D7 are the positions from which the parts of the developer are removed from the developing roller 320; the second positions G1, G3, G5, and G7 are the positions at which the parts of the developer reach the surface B2; and distances (displacements) F1, F3, F5, and F7 are respectively the distances between the first positions D1, D3, D5, and D7 and the second positions G1, G3, G5, and G7 in the first transport direction A8. The larger the inclination of the guide surface 420, the larger the kinetic energy of the developer in the downstream direction that is guided by the guide surface 420. In this case, the inclinations of the guide surfaces 420 have a relationship such that those of the guide surfaces 421>423>425>427, so that the displacements have a relationship such that F1>F3>F5>F7. That is, the more upstream the position of the plate-shaped member 410, the larger the inclination of the guide surface 420, and the larger the displacement. Therefore, the more upstream the position from which the developer is removed from the developing roller 320, the larger the displacement of the second position that the developer reaches in the downstream direction. Because the plate-shaped members 410 guide the developer as described above, the amount of developer that reaches the developer that is contained in the first container 311 increases in the downstream direction. Thus, unevenness in the amount of developer supplied to the photoconductor drum 100 in the first transport direction A8, i.e., the direction along the rotation axis of the developing roller 320, is reduced.

Second Exemplary Embodiment

Next, a developing device 300*a* according to a second exemplary embodiment of the present invention will be described. The difference between the first and second exemplary embodiments will be mainly described.

Figure 8:
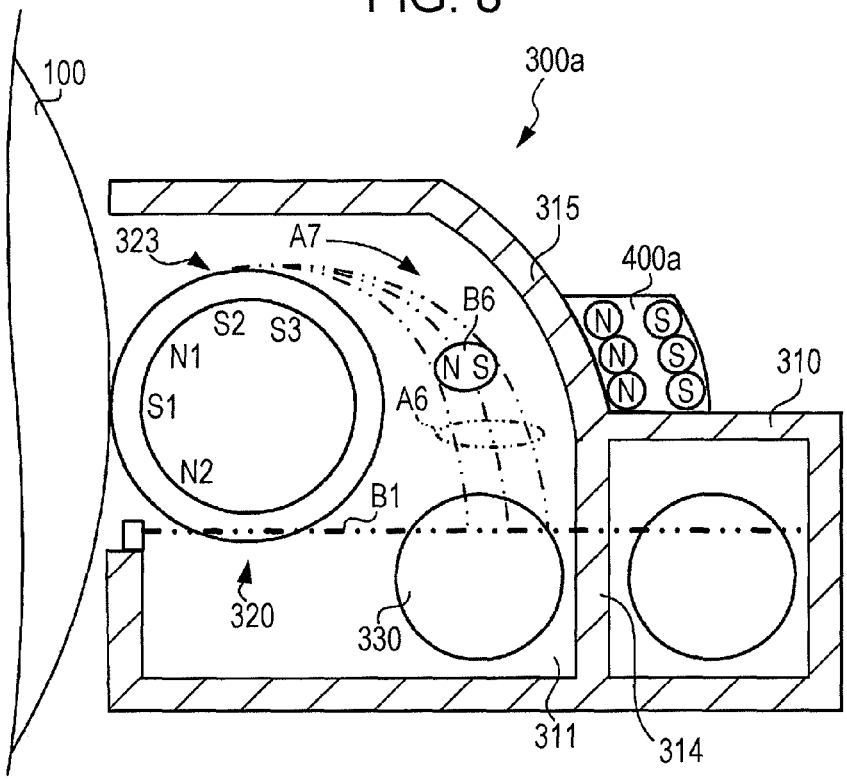
FIG. 8 illustrates the structure of a developing device according to a second exemplary embodiment.

FIG. 8 illustrates the structure of the developing device 300*a* according to the second exemplary embodiment. The developing device 300*a* includes a guide member 400*a*. The guide member 400*a* includes a magnetic member that generates magnetic flux. In the present exemplary embodiment, the guide member 400*a* is disposed outside an outer wall 315 of the housing 310 that extends along the imaginary parabola A6 such that the north poles of the guide member 400*a* are oriented toward the inside of the housing 310. The magnetic flux generated by the magnetic member generates magnetic poles in the magnetic substance (the magnetic carrier described above) included in the developer B6 that is moving toward the surface B1. To be specific, a south pole is generated on the guide member 400*a* side of the developer B6 and a north pole is generated on the opposite side of the developer B6. Thus, an attractive force is generated between the south pole that is generated on the guide member 400*a* side of the developer B6 and the north pole of the guide member 400*a*, whereby the developer B6 is guided toward the downstream direction due to the attractive force. The guide member 400*a* may be disposed at any position at which the magnetic flux from the guide member 400*a* is able to apply an attractive force to the moving developer B6. The developing roller 320 and the first transport roller 330 each include a member that generates magnetic flux. The guide member 400*a* is disposed at a position such that the guide member 400*a* generates a force that attracts the developer B6 in a region that is different from regions in which these rollers generate magnetic flux. Thus, with the developing device 300*a*, unevenness in the amount of developer supplied to the photoconductor drum 100 in the first transport direction A8 is more stably reduced than the case where the magnetic flux from these rollers influence the attractive force.

Figure 9:
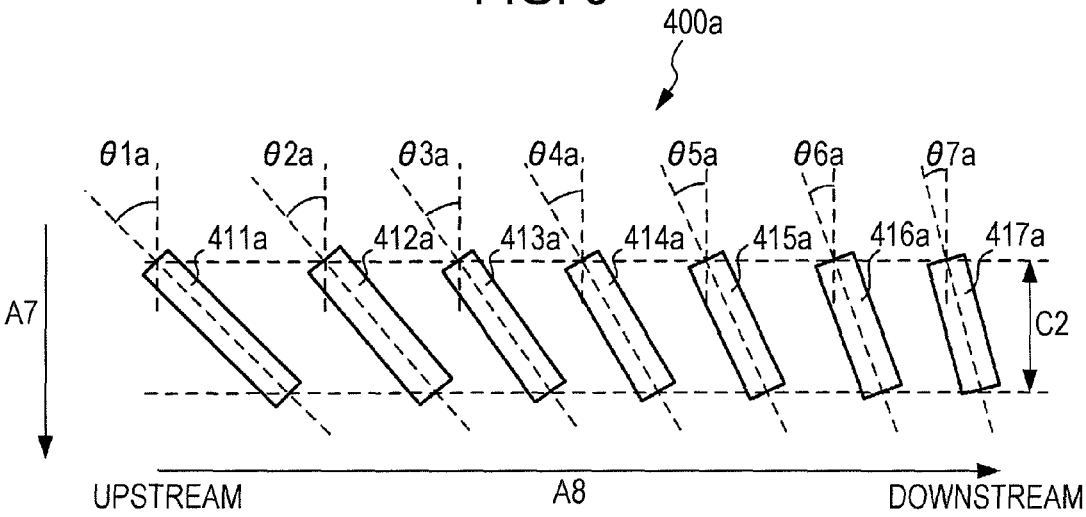
FIG. 9 illustrates a guide member when seen in a horizontal direction from a developing roller side.

FIG. 9 illustrates the guide member 400*a* when seen in a horizontal direction from the developing roller 320 side illustrated in FIG. 8. In FIG. 9, the direction A7 is the vertical component of the movement direction A7 illustrated in FIG. 8, and the direction A8 is the same as the first transport direction A8 illustrated in FIG. 5. The guide member 400*a* includes plate-shaped magnetic members 411*a*, 412*a*, 413*a*, 414*a*, 415*a*, 416*a*, and 417*a* (which will be referred to as "magnetic members 410*a*" when they are not distinguished from each other). The magnetic members 410*a* are arranged in the first transport direction A8. The length (height) of each of the magnetic members 410*a* in the vertical direction is C2. Each of the magnetic members 410*a* has a magnetic body, and the magnetic bodies generate magnetic flux from the entirety of the magnetic members 410*a* illustrated in FIG. 9.

Each of the magnetic members 410*a* is inclined with respect to the vertical direction such that the lower end thereof in the vertical direction is located downstream of the upper end thereof in the vertical direction. To be specific, when seen horizontally from the developing roller 320 side as illustrated in FIG. 9, the magnetic members 410*a* respectively have angles θ1*a*, θ2*a*, θ3*a*, θ4*a*, θ5*a*, θ6*a*, and θ7*a* with respect to the vertical direction. The more upstream the position of the magnetic member 410*a*, the larger the angle, i.e., θ1*a*>θ2*a*>θ3*a*>θ4*a*>θ5*a*>θ6*a*>θ7*a*. The angles are larger than 0 degrees and smaller than 90 degrees. Because the magnetic members 410*a* are disposed as described above, the magnetic bodies of the magnetic members 410*a* are inclined at the same angles with respect to the vertical direction. Due to the inclinations, the magnetic bodies apply downstream forces to the developer that is moving in the movement direction A7, and guide the developer toward the downstream direction. To be specific, the lower a part of each of the magnetic bodies in the vertical direction, the more downstream the magnetic flux generated by the part of the magnetic body. Therefore, as the developer moves in the movement direction A7, an attractive force generated by a downstream part of the magnetic body is applied to the developer, whereby a downstream force is generated. Thus, the magnetic member 410*a* guides the developer toward the downstream direction by using the magnetic force.

Figure 10:
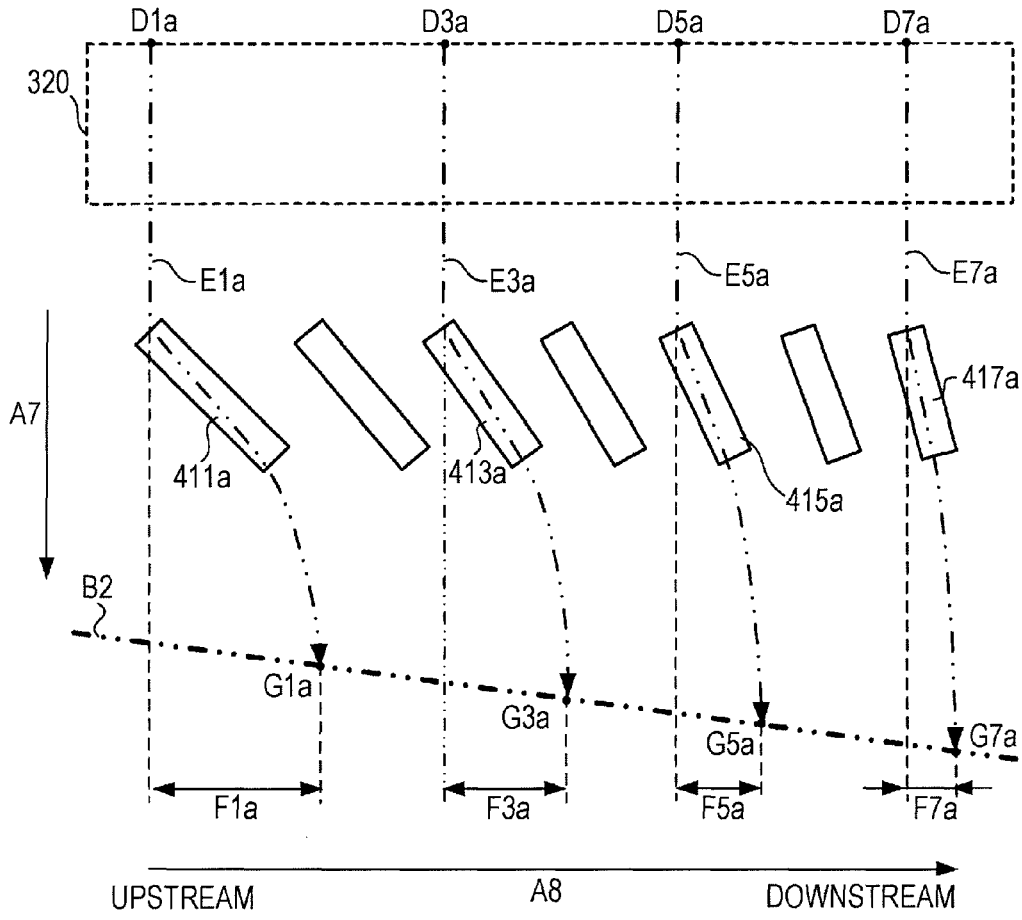
FIG. 10 illustrates examples of trajectories of the developer that is guided toward the downstream direction by a guide member.

FIG. 10 illustrates examples of trajectories of the developer that is guided toward the downstream direction by the magnetic member 410*a*. In FIG. 10, the direction A7 is the vertical component of the movement direction A7 illustrated in FIG. 8, and the direction A8 is the same as the first transport direction A8 illustrated in FIG. 5. In FIG. 10, the developing roller 320 illustrated in FIG. 8 is schematically illustrated by a broken line. Due to attractive forces generated by the magnetic members 410*a*, the developer that has been removed from the developing roller 320 illustrated in FIG. 8 has kinetic energy in the downstream direction, so that the developer moves along parabolas oriented toward the downstream direction and reaches the surface B2. As a result, the developer reaches the positions of the surface B2 that are displaced downstream in the first transport direction A8 from the positions that the developer would have reached if the developer was not guided by the magnetic members 410*a*, i.e., the positions from which the developer was removed from the developing roller 320 illustrated in FIG. 8.

In FIG. 10, the trajectories of parts of the developer that are attracted by the magnetic flux generated at upper ends of the magnetic members 411*a*, 413*a*, 415*a*, and 417*a* in the vertical direction are respectively illustrated by two-dot chain lines E1*a*, E3*a*, E5*a*, and E1*a*. In FIG. 10, first positions D1*a*, D3*a*, D5*a*, and D7*a* are the positions from which the parts of the developer are removed from the developing roller 320; the second positions G1*a*, G3*a*, G5*a*, and G7*a* are the positions at which the parts of the developer reach the surface B2, and displacements F1*a*, F3*a*, F5*a*, and F1*a* are respectively the distances between the first positions D1*a*, D3*a*, D5*a*, and D7*a* and the second positions G1*a*, G3*a*, G5*a*, and G7*a*. The larger the inclination of the magnetic member 410*a* with respect to the vertical direction, the larger the kinetic energy, in the downstream direction, of the developer that is guided by the magnetic member 410*a*. In this case, the inclinations of the magnetic members 410*a* have a relationship such that those of the magnetic members 411*a*>413*a*>415*a*>417*a*, so that the displacements have a relationship such that F1*a*>F3*a*>F5*a*>F7*a*. That is, the more upstream the position of the magnetic member 410*a*, the larger the inclinations of the magnetic member 410*a* and the magnetic body of the magnetic member 410*a*, and the larger the displacement. Therefore, the more upstream the position from which the developer is removed from the developing roller 320 illustrated in FIG. 8, the larger the displacement of the position at which the developer reaches the surface B2 in the downstream direction. Because the magnetic members 410*a* guide the developer as described above, the amount of developer that reaches the developer that is contained in the first container 311 increases in the downstream direction. Thus, unevenness in the amount of developer supplied to the photoconductor drum 100 in the direction along the rotation axis of the photoconductor drum 100 illustrated in FIG. 8 is reduced.

When the magnetic members 410*a* are disposed outside the housing as illustrated in FIG. 8, it is not necessary to prepare a space for disposing the magnetic members 410*a* in the housing. Therefore, the developing device 300*a* may have a housing smaller than the housing 310, in which the guide member 400 is disposed as illustrated in FIG. 3. Alternatively, the magnetic members 410*a* may be disposed in the housing. In either case, the magnetic members 410*a* illustrated in FIG. 9 may be disposed at positions at which the developer that is moving does not adhere to the magnetic member 410*a*. Thus, the developer reaches the surface B2 without being subjected to resistance due to a collision or adhesion, whereby the developer reaches the surface B2 faster than the case where the developer is subjected to such resistance.

Modifications

The exemplary embodiments described above may be modified as described below. Moreover, the modifications described below may be used in combination.

First Modification

A mechanism for physically removing the developer that remains on the developing roller may be provided.

Differences between a developing device according to the present modification and the first exemplary embodiment will be mainly described.

Figure 11:
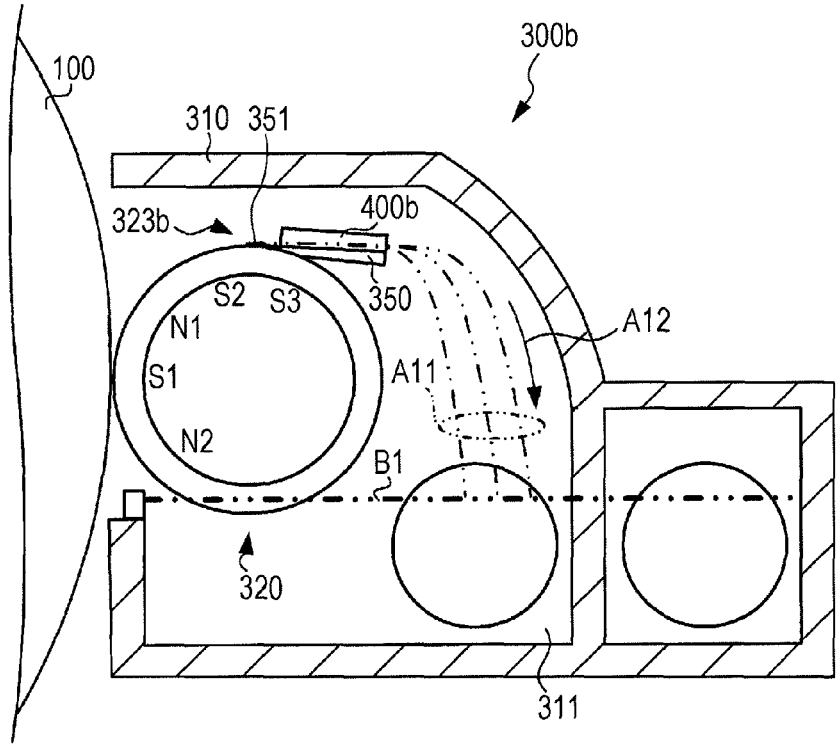
FIG. 11 illustrates the structure of a developing device according to a modification.

FIG. 11 illustrates the structure of a developing device 300*b* according to the present modification. The developing device 300*b* includes a guide member 400*b* and a removing member 350. The removing member 350 is a plate-shaped member that is disposed in the housing 310 such that an end portion 351 thereof is in contact with a removal region 323*b* on the surface of the developing roller 320. The removing member 350 applies a physical force to the developer that has been transported on the surface of the developing roller 320 to the removal region 323*b*, and removes the developer from the surface of the developing roller 320. The removed developer passes a space above the removing member 350 in the vertical direction, and then moves toward the first container 311. The guide member 400*b* is disposed on the upper surface of the removing member 350 in the vertical direction (the surface over which the removed developer moves) and on an imaginary parabola A11 that is the trajectory of the developer that passes over the removing member 350. The guide member 400*b* guides the developer, which moves along the imaginary parabola A11 in a movement direction A12, toward the downstream direction. The removing member 350 is an example of a "plate-shaped member", and the end portion 351 is an example of a "contact portion".

Figure 12:
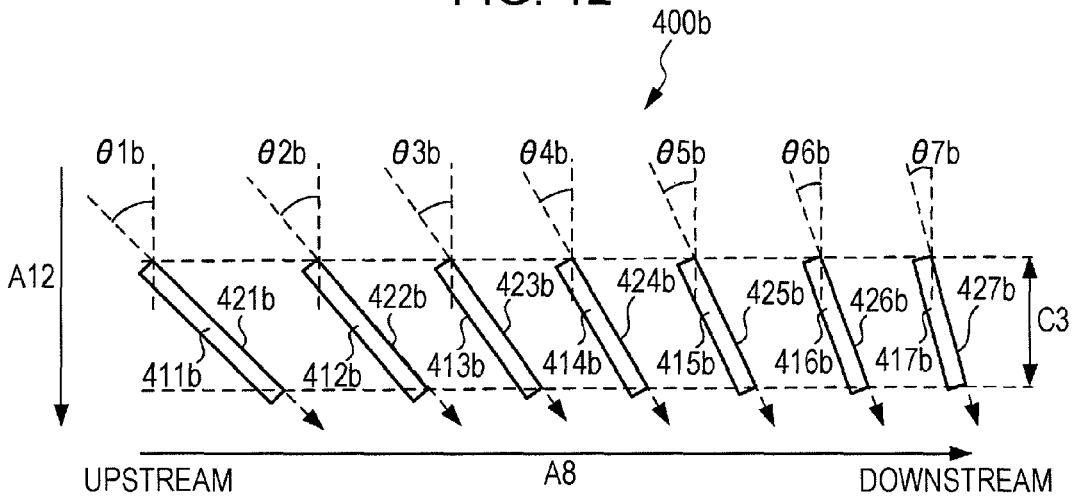
FIG. 12 illustrates a guide member when seen in a direction toward a surface on which the guide member is disposed.

FIG. 12 illustrates the guide member 400*b* when the removing member 350 is seen in the direction toward the surface on which the guide member 400*b* is disposed. In FIG. 12, the movement direction A12 is the same as that illustrated in FIG. 11, and the first transport direction A8 is the same as that illustrated in FIG. 5. The guide member 400*b* includes plate-shaped members 411*b*, 412*b*, 413*b*, 414*b*, 415*b*, 416*b*, and 417*b* (which will be referred to as "plate-shaped members 410*b*" when they are not distinguished from each other). The plate-shaped members 410*b* are arranged in the first transport direction A8. The length (height) of each of the plate-shaped members 410*b* in the movement direction A12 is C3. The plate-shaped members 410*b* respectively have guide surfaces 421*b*, 422*b*, 423*b*, 424*b*, 425*b*, 426*b*, and 427*b* (which will be referred to as "guide surfaces 420*b*" when then are not distinguished from each other) that guide the developer when the developer reaches the plate-shaped members 410. That is, the guide surfaces 420*b* are disposed on the removing member 350.

Each of the plate-shaped members 410*b* is inclined with respect to the movement direction A12 such that the distal end thereof in the movement direction A12 is located downstream, in the first movement direction A8, of the proximal end thereof in the movement direction A12. To be specific, as illustrated in FIG. 12, the guide surfaces 420*b* of the plate-shaped members 410*b* have angles θ1*b*, θ2*b*, θ3*b*, θ4*b*, θ5*b*, θ6*b*, and θ7*b* with respect to the vertical direction. The more upstream the position of the plate-shaped member 410*b*, the larger the angle, i.e., θ1*b*>θ2*b*>θ3*b*>θ4*b*>θ5*b*>θ6*b*>θ7*b*. The angles are larger than 0 degrees and smaller than 90 degrees. Due to such inclinations, each of the guide surfaces 420*b* of the plate-shaped members 410*b* blocks the imaginary parabola A11 illustrated in FIG. 11. That is, the guide surfaces 420*b* of the plate-shaped members 410*b* are disposed so that the moving developer reaches the guide surfaces 420*b*. The guide surfaces 420*b* apply downward forces to the developer that reaches the guide surfaces 420*b*, and guide the developer toward the downstream direction. The guide surfaces 420*b* are examples of a "guide portion" and a "plurality of surfaces".

Figure 13:
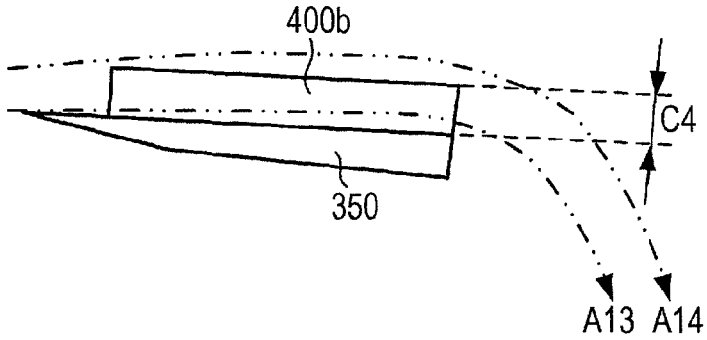
FIG. 13 illustrates a side view of the guide member.

FIG. 13 illustrates a side view the guide member 400*b*. The height of the guide member 400*b* above the surface of the removing member 350, on which the guide member 400*b* is disposed, is C4. In FIG. 13, an imaginary parabola A13 and an imaginary parabola A14 are trajectories along which the developer that has been removed from by the removing member 350 moves. A part of the developer that moves along the imaginary parabola A13 is guided downstream by the guide member 400*b*. A part of the developer that moves along the imaginary parabola A14 moves at a distance from the removing member 350 that is larger than C4. Therefore, the developer does not reach the guide member 400*b*, and is not guided toward the downstream direction by the guide member 400*b*. If, for example, the thickness of the removed developer is larger than C4, the guide member 400*b* guides downstream a part of the developer at or below the thickness C4, and does not guide a part of the developer above the thickness C4. By adjusting the height of the guide member 400*b*, the guide member 400*b* may function so as to guide a desired amount of developer downstream and so as not to guide the remaining amount.

Second Modification

The developing device may include two developing rollers. The difference between the first exemplary embodiment and the developing device according to the present modification will be mainly described.

Figure 14:
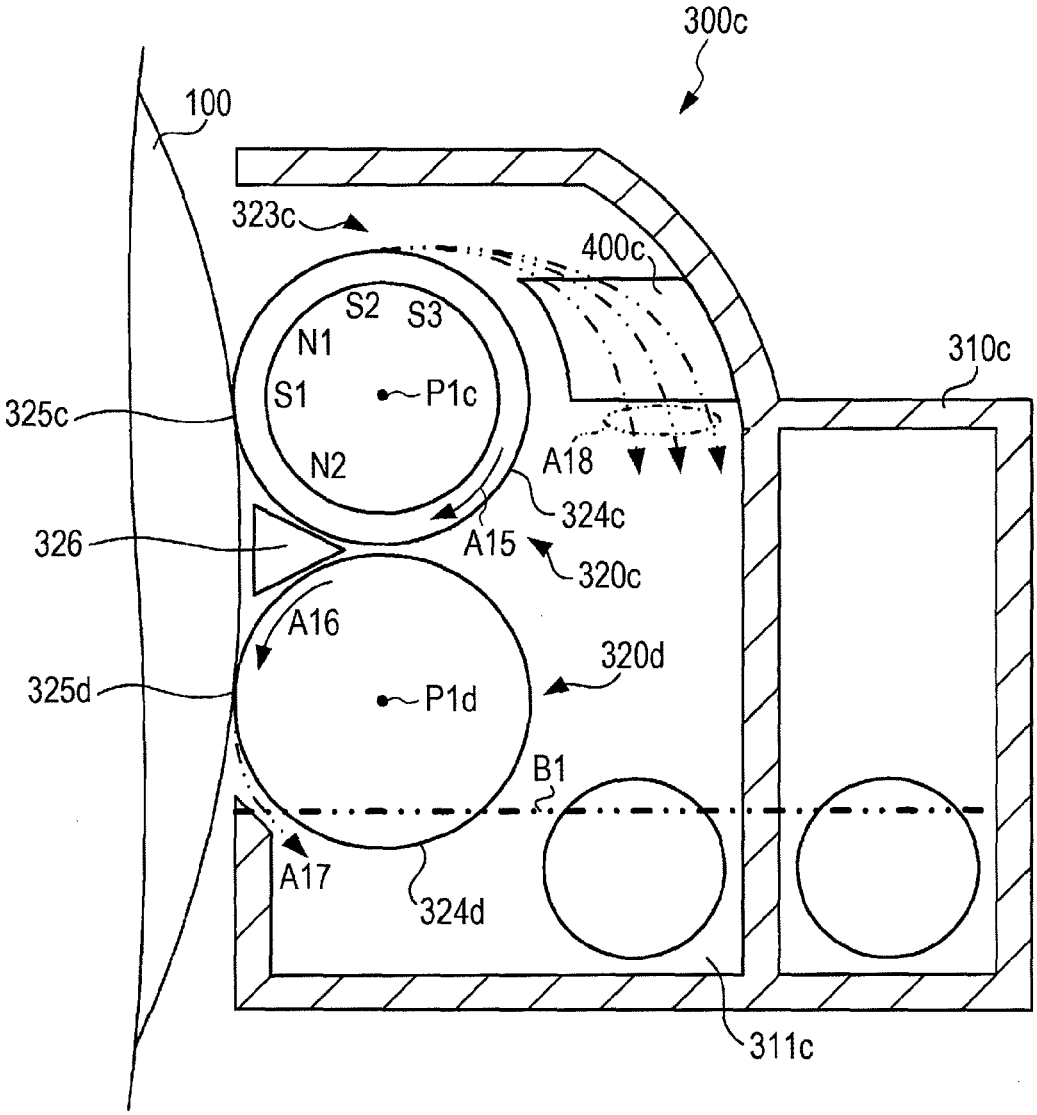
FIG. 14 illustrates the structure of a developing device according to a modification.

FIG. 14 illustrates the structure of a developing device 300*c* according to the present modification. The developing device 300*c* includes a housing 310*c*, a developing roller 320*c*, a developing roller 320*d*, a separation member 326, and a guide member 400*c*. The developing rollers 320*c* and 320*d*, which are arranged vertically, supply the developer to the photoconductor drum 100. The surfaces of the developing rollers 320*c* and 320*d* are in contact with the surface of the photoconductor drum 100. The developing rollers 320*c* and 320*d*, which are arranged vertically, are supported by the housing 310*c* so as to be rotatable around the rotation axes P1*c* and P1*d*, respectively. The rotation axis P1*d* of the developing roller 320*d* extends along the rotation axis P1 in the first transport direction A8 illustrated in FIG. 5. Each of the developing rollers 320*c* and 320*d* is an example of a "developer carrier". The developing roller 320*c* rotates in the direction of arrow A15, and transports the developer held on a surface 324*c* toward the separation member 326. The developing roller 320*d*, which is disposed vertically below the developing roller 320*c*, holds the developer contained in a first container 311*c* on a surface 324*d* thereof and transports the developer. The developing roller 320*d* rotates in the direction of arrow A16, and transports the developer held on the surface 324*d* toward the separation member 326.

The separation member 326 is disposed between the developing roller 320*c* and the developing roller 320*d*. The separation member 326 separates the transported developer into two in the vertical direction (to the developing roller 320*c* side and to the developing roller 320*d* side). By changing the position of the separation member 326, the amount of the developer supplied to the developing roller 320*c* and the amount of developer supplied to the developing roller 320*d* are changed. In the present modification, the separation member 326 is disposed so that the same amount of developer is supplied to the developing roller 320*c* and to the developing roller 320*d*. The developing rollers 320*c* and 320*d* respectively transport the developer supplied by the separation member 326, and supply the developer to the surface 101 of the photoconductor drum 100 at facing portions 325*c* and 325*d*, at which the developing rollers 320*c* and 320*d* face the photoconductor drum 100. Because the developer is supplied at two positions in the developing device 300*c*, the amount of developer supplied to the surface of the photoconductor drum 100 is reliably prevented from being reduced even if the photoconductor drum 100 rotates with a high speed, as compared with the case where the developer is supplied at one position.

Subsequently, the developing roller 320*d* transports the developer (mainly a magnetic carrier) that has passed the facing portion 325*d* and remains on the surface of the developing roller 320*d* in the direction of arrow A17 and returns the developer to the first container 311*c*. The developing roller 320*c* removes the developer (mainly a magnetic carrier) that has passed the facing portion 325*c* and remains on the surface of the developing roller 320*c* in a removal region 323*c* by using magnetic flux generated by the magnetic poles S2 and S3. If the guide member 400*c* is not present, the removed developer moves along the imaginary parabola A18 and reaches the surface B1. The guide member 400*c* has a structure the same as that of the guide member 400 of the first exemplary embodiment. The guide member 400*c* is disposed on the imaginary parabola A18 and guides the moving developer toward the downstream direction. Thus, in the developing device 300*c*, unevenness in the amount of developer contained in the first container 311*c* in the first transport direction A8 is reduced. Accordingly, unevenness in the amount of developer supplied to the photoconductor drum 100 in the direction along the rotation axis of the photoconductor drum 100 is reduced. The developing device 300*c* may include a guide member that guides, toward the downstream direction, the developer that passes the facing portion 325*d*.

By changing the position of the separation member 326 in the developing device 300*c*, the degree to which unevenness in the amount of supplied developer is reduced is changed. For example, when the separation member 326 is displaced downward in the vertical direction, the amount of developer separated toward the developing roller 320*c* is increased as compared with the case where the separation member 326 is disposed at the original position (in the original state). In this case, as compared with the original state, the amount of developer that is guided toward the downstream direction by the guide member 400*c* is increased, whereby the degree to which unevenness in the amount of developer contained in the first container 311*c* is reduced is increased. As a result, with the developing device 300*c*, the degree to which unevenness in the amount of developer supplied to the photoconductor drum 100 in the direction along the rotation axis of the photoconductor drum 100 is reduced is increased as compared with the original state.

Third Modification

Figure 15:
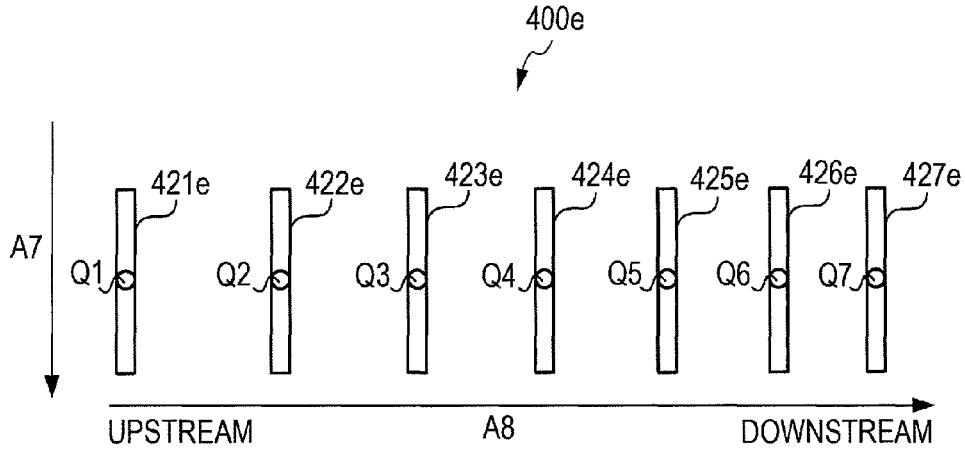
FIG. 15 illustrates a guide member according to a modification.
Figure 16:
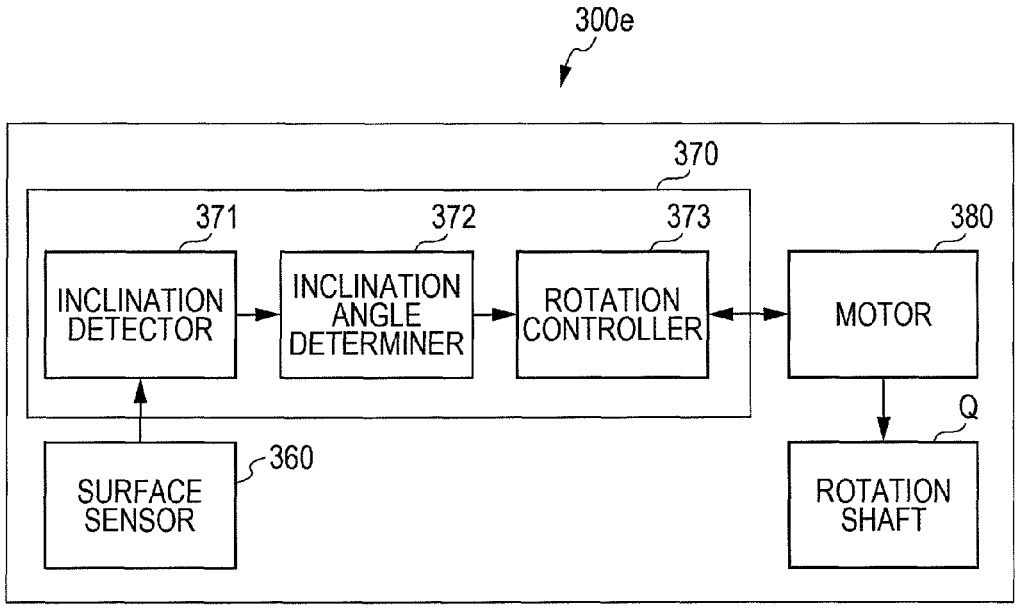
FIG. 16 is a block diagram illustrating a mechanism that rotates the guide member.
Figure 17:
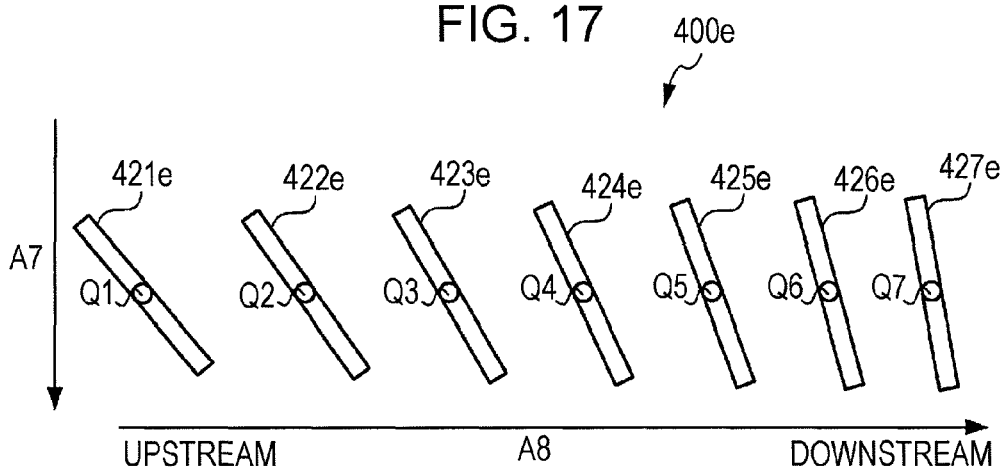
FIG. 17 illustrates plate-shaped members that are rotated.

In the exemplary embodiments described above, the plate-shaped member and the magnetic member are fixed in place. However, these members may be movable. By changing the degree to which the guide surfaces of the plate-shaped members or the magnetic members guide the developer toward the downstream direction, the degree to which the inclination of the surface of the developer in the first container is decreased is changed. For example, if the inclination of the surface of the developer is large, the degree to which the developer is guided toward the downstream direction is large. If the inclination of the surface of the developer is small, the degree to which the developer is guided downstream is small. Referring to FIGS. 15, 16, and 17, an example of the structure of a developing device according to the present modification will be described. In these figures, the difference from the developing device 300 illustrated in FIG. 3 will be mainly described.

FIG. 15 illustrates a guide member 400*e* according to the present modification. In FIG. 15, the direction A7 is the vertical component of the movement direction A7 illustrated in FIG. 3, and the first transport direction A8 is the same as that illustrated in FIG. 5. The guide member 400*e* includes plural plate-shaped members. The plate-shaped members respectively have guide surfaces 421*e*, 422*e*, 423*e*, 424*e*, 425*e*, 426*e*, and 427*e* (which will be referred to as "guide surfaces 420*e*" when they are not distinguished from each other). The plate-shaped members respectively have rotation shafts Q1, Q2, Q3, Q4, Q5, Q6, and Q7 (which will be referred to as "rotation shafts Q" when they are not distinguished from each other). The plate-shaped members are supported by the housing 310 illustrated in FIG. 3 so as to be rotatable around the rotation shafts Q. When the plate-shaped members are rotated around the rotation shafts Q by driving forces provided by a motor (not shown), the angles of the guide surfaces 420*e* with respect to the horizontal direction are changed. The guide surface 420*e* in the present modification are an example of a "guide portion" and a "plurality of surfaces".

FIG. 16 is a block diagram illustrating a mechanism that rotates the plate-shaped members of a developing device 300*e* according to the present modification. The developing device 300*e* includes a surface sensor 360, a controller 370, and a motor 380. The surface sensor 360 is a sensor for detecting the position of the surface B2 of the developer contained in the first container 311 illustrated in FIG. 5. The surface sensor 360 detects at least two positions of the surface B2, i.e., a position of the surface B2 in an upstream part of the first container 311 and a position of the surface B2 in a downstream part of the first container 311. The surface sensor 360 supplies data representing the detected positions to the controller 370. The controller 370 includes a central processing unit (CPU), a read only memory (ROM), and a random access memory (RAM). The function block including an inclination detector 371, an inclination angle determiner 372, and a rotation controller 373 is implemented in a function program. The function program is stored in the ROM, loaded by the CPU into the RAM, and executed by the CPU.

The inclination detector 371 calculates the thicknesses (heights from the bottom surface) of the developer and detects the inclination of the developer by using the positions of the surface B2 represented by the data supplied from the surface sensor 360 and the position of the bottom surface of the housing 310, which is known beforehand. To be specific, by using the values of the thicknesses, the inclination detector 371 calculates the angle of the surface B2 with respect to the first transport direction A8. The surface sensor 360 and the inclination detector 371 cooperate to detect the inclination of the surface of the developer with respect to the first transport direction A8, and function as a "detector". The detector is not limited thereto, as long as the detector detects the inclination of the developer. For example, a sensor that detects the thickness (height from the bottom surface) of the developer, a sensor that detects the inclination of the developer, or other devices may be used. The inclination detector 371 supplies data representing the calculated angle to the inclination angle determiner 372.

On the basis of the angle represented by the supplied data, the inclination angle determiner 372 determines the angles (inclination angles) by which the guide surfaces 420*e* are to be inclined. To be specific, if the developer has no inclination (if the angle is 0 degrees), the inclination angle determiner 372 determines 0 degrees as the inclination angles of the guide surfaces 420*e*. As the inclination of the developer becomes larger, the inclination angle determiner 372 determines a larger inclination angle for each of the guide surfaces 420*e* by incrementing the angle of the guide surface 420*e* by a predetermined value. For example, every time the angle representing the inclination of the developer increases by one degree, the inclination angle of the guide surface 421*e* is increased by 4 degrees and the inclination angle of the guide surface 427*e* is increased by one degree. The inclination angle determiner 372 supplies data representing the inclination angles to the rotation controller 373.

The rotation controller 373 controls the rotation of the motor 380 on the basis of the supplied data. The motor 380 is connected to the rotation shafts Q and rotates the rotation shafts Q. When the motor 380 is stopped, the rotation shafts Q are fixed so that the guide surfaces 420*e* are held at rest. The rotation controller 373 controls the rotation of the motor 380 so that the guide surfaces 420*e* are rotated to the positions at which the guide surfaces 420*e* have the inclination angles represented by the supplied data and fixed at the positions. Thus, as illustrated in FIG. 17, the more upstream the position of the guide surface 420*e*, the larger the inclination angle of the guide surface 420*e* with respect to the vertical direction. The inclination angle determiner 372, the rotation controller 373, and the motor 380 cooperate to function as a device that changes the inclinations of the guide surfaces 420*e* so that the larger the inclination of the developer the larger the inclination angles of the guide surfaces 420*e*. The inclination angle determiner 372, the rotation controller 373, and the motor 380 cooperate to change the inclinations of the guide surface 420*e* on the basis of the inclination of the developer detected by the inclination detector 371, and function as a "changing unit".

Fourth Modification

Figure 18:
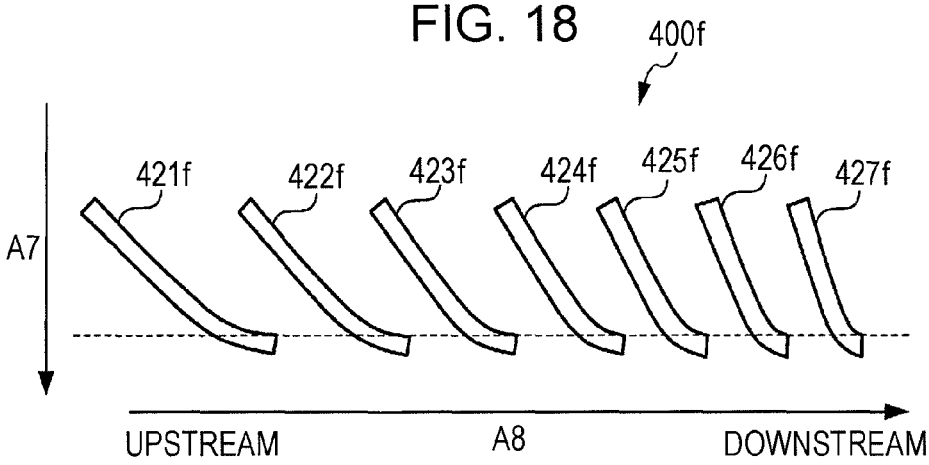
FIG. 18 illustrates a guide member according to the modification.
Figure 19:
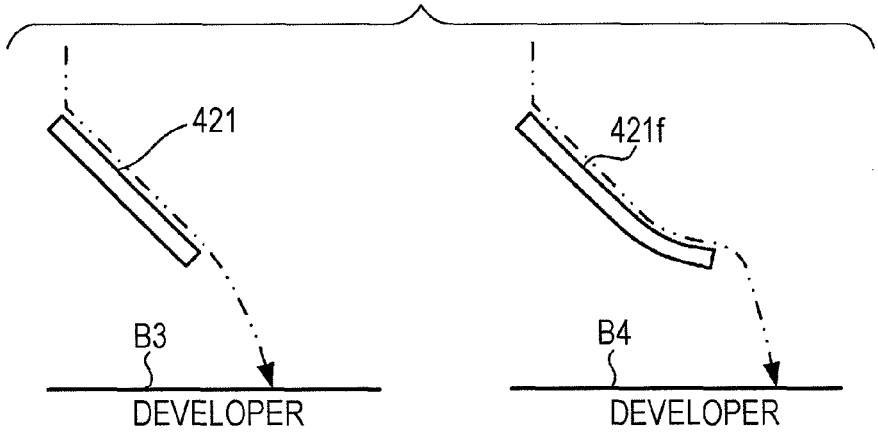
FIG. 19 illustrates a comparison between developers that are guided by guide members.

A downstream portion of the guide surface or the magnetic member in the vertical direction may be curved toward the downstream direction. For example, as illustrated in FIG. 6, lower parts of plate-shaped members 410 in the vertical direction are curved toward the downstream direction (i.e., the guide surface are curved toward the downstream direction). Referring to FIGS. 18 and 19, an example of the structure of a developing device according to the present modification will be described. The difference between the developing device and the developing device 300 illustrated in FIG. 3 will be mainly described.

FIG. 18 illustrates a guide member 400*f* according to the present modification. In FIG. 18, the direction A7 is the movement direction A7 illustrated in FIG. 3, and the first transport direction A8 is the same as that illustrated in FIG. 5. The guide member 400*f* has plural plate-shaped members having lower portions that are curved toward the downstream direction. The plate-shaped members 410*f* respectively have guide surfaces 421*f*, 422*f*, 423*f*, 424*f*, 425*f*, 426*f*, and 427*f* (which will be referred to as "guide surfaces 420*f*" when they are not distinguished from each other). The plate-shaped members are disposed in the housing such that the lower ends of the guide surfaces 420*f* thereof in the vertical direction are positioned downstream of the upper ends thereof. The guide surfaces 420*f* are an example of a "guide portion" and a "plurality of surfaces".

FIG. 19 illustrates a comparison between the developer that is guided by the guide surface 421*f* and the developer that is guided by the guide surface 421 of the first exemplary embodiment. The developer guided by the guide surface 421*f* decelerates in a curved portion in a lower part of the guide surface 421*f* in the vertical direction, and is ejected in a direction that is closer to a horizontal direction than a direction in which the developer guided by the guide surface 421 is ejected. Therefore, the kinetic energy of the developer, which is guided by the guide surface 421*f*, in the vertically downward direction is smaller than that of the developer guided by the guide surface 421. As a result, the impact that is applied to the surface B4 by the developer guided by the guide surface 421*f* in the vertical direction is smaller than the impact that is applied to the surface B3 by the developer guided by the guide surface 421 in the vertical direction, so that generation of dust from the surface B4 is reduced. In the present modification, it is sufficient that at least one of the guide surfaces be curved toward the downstream direction. Also in this case, generation of dust of the developer guided by the curved guide surface is reduced as compared with the case where the guide surface is not curved.

Fifth Modification

The guide member may be disposed at any position as long as the guide member is capable of guiding the moving developer downstream in the first transport direction on an imaginary parabola along which the removed developer moves. For example, the guide member may be disposed upstream or downstream of the guide member 400 illustrated in FIG. 3 in the movement direction A7.

Sixth Modification

Figure 20:
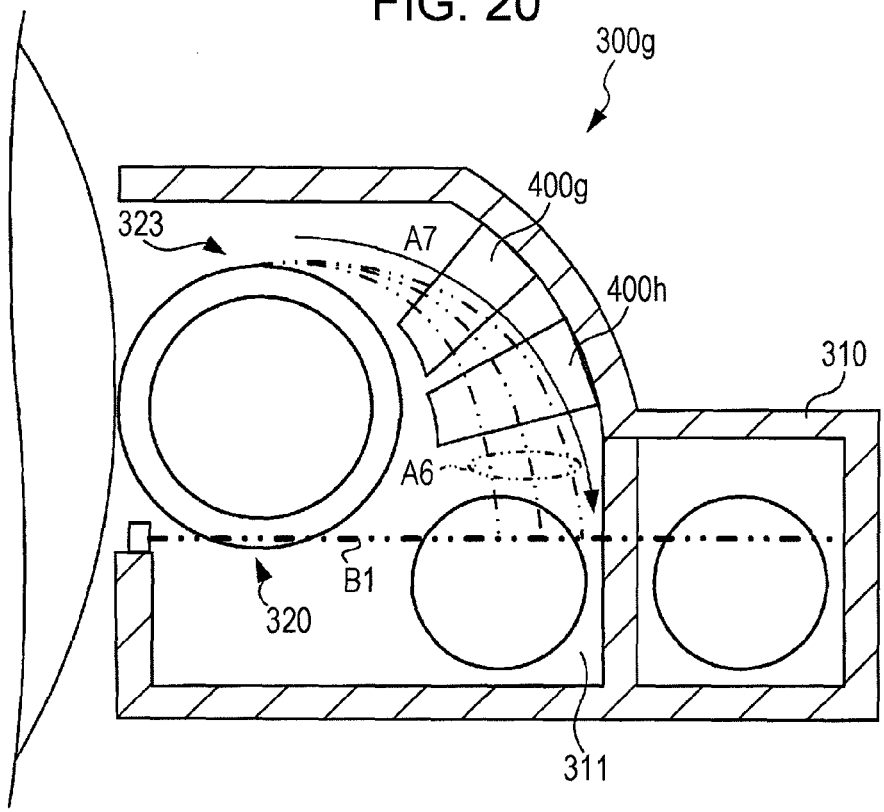
FIG. 20 illustrates the structure of a developing device according to the modification.
Figure 21:
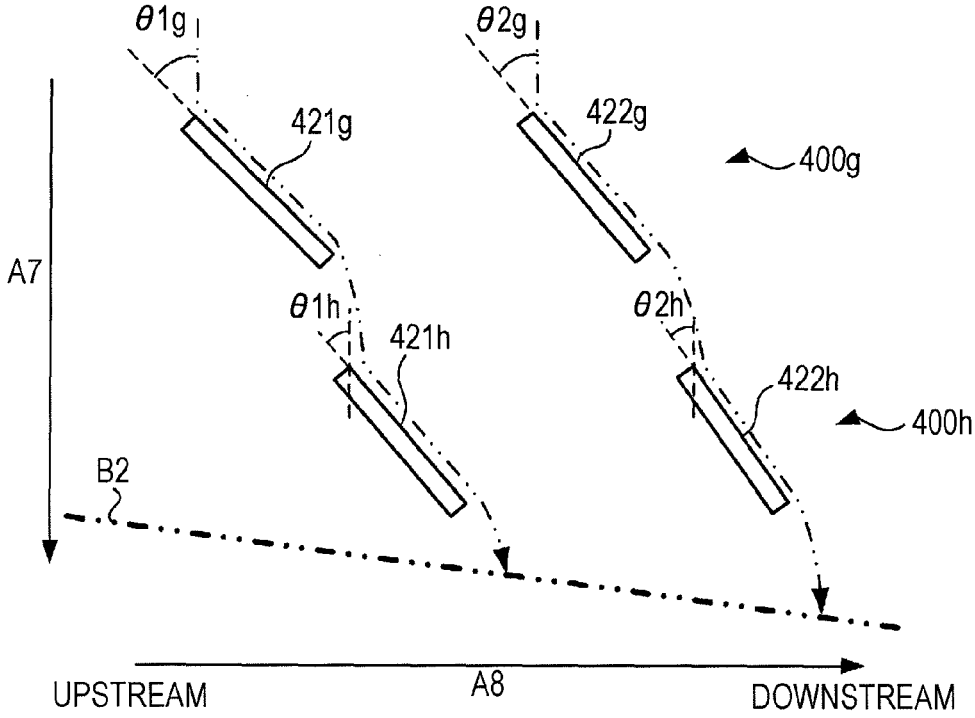
FIG. 21 illustrates examples of trajectories of the developer guided toward the downstream direction by guide members.

The number of the guide members is not limited to one, and there may be plural guide members. Referring to FIGS. 20 and 21, the structure of a developing device according to the present modification will be described. The difference between the developing device and the developing device 300 illustrated in FIG. 3 will be mainly described.

FIG. 20 illustrates a developing device 300*g* according to the present modification. The developing device 300*g* includes guide members 400*g* and 400*h* that are disposed on the imaginary parabola A6 in the housing 310. The developer that has been removed from the developing roller 320 in the removal region 323 and that is moving toward the surface B1 reaches the guide members 400*g* and 400*h*, and the developer is guided by the guide members 400*g* and 400*h* in the downstream direction.

FIG. 21 illustrates examples of trajectories of the developer guided toward the downstream direction by the guide members 400*g* and 400*h*. In FIG. 21 the direction A7 is the vertical component of the movement direction A7 illustrated in FIG. 20, and the first transport direction A8 is the same as that illustrated in FIG. 5. The guide member 400*g* includes plate-shaped members respectively having guide surfaces 421*g* and 422*g*, and the guide member 400*h* includes plate-shaped members respectively having guide surfaces 421*h* and 422*h*. The guide surfaces 421*g* and 422*g* are respectively inclined by angles θ1*g* and θ2*g* with respect to the vertical direction, and the guide surfaces 421*h* and 422*h* are respectively inclined by angles θ1*h* and θ2*h* with respect to the vertical direction. The guide surface 421*h* is disposed on an imaginary parabola along which the developer guided by the guide surface 421*g* moves, and guides the developer further downstream. The guide surface 422*h* is disposed on an imaginary parabola along which the developer guided by the guide surface 422*g* moves, and guides the developer further downstream. Thus, the guide members 400*g* and 400*h* guide the developer so that the developer is moved further downstream (i.e., so that the displacements of the developer are increased) as compared with the case where only one guide portion is used.

Seventh Modification

In the exemplary embodiments described above, the number of the guide surfaces or the magnetic members is seven. However, the number is not limited thereto, and may be any number equal to or larger than two. In this case, the number of the guide surfaces or magnetic members may increased when the length of each of the guide surfaces or the magnetic members in the vertical direction is small. The longer the guide surface or the magnetic member of the guide member in the vertical direction, the larger the amount of developer guided downstream. If the length of each of the guide surfaces or the magnetic members in the vertical direction is large and the number of the guide surfaces or the magnetic members is large, the guide surfaces or the magnetic members overlap in the vertical direction. The overlapping portions are unused and unnecessary. By providing a large number of guide surfaces or the magnetic members when the length in the vertical direction is small, the overlapping and unnecessary portions are reduced. Moreover, as compared with the case where the length in the vertical direction is increased and the number of the guide surfaces and the magnetic members are increased, the efficiency of guiding the developer by the guide member (for example, the ratio of the sum of the lengths of the guide surfaces or the magnetic members in the vertical direction to the product of the amount of guided developer and the distance that the developer is moved in the first transport direction) is increased.

Eighth Modification

In the exemplary embodiments described above, the guide member extends over the entire length of the developing roller 320 in the first transport direction A8. However, this is not limited thereto, and the guide member may extend over only a part of the length of the developing roller 320. For example, the guide member may extend over half the length of the developing roller 320. Also in this case, the amount of developer that reaches the first transport roller on the upstream side of the guide portion (for example, plural guide surfaces or plural magnetic members), which guides the developer held by the guide member, is made smaller than the amount of developer that reaches the first transport roller on the downstream side of the guide portion. Thus, the developer that passes a region in which the guide portion is disposed is guided toward the downstream direction, and thereby unevenness in the amount of developer in the region is reduced.

Ninth Modification

In the first exemplary embodiment described above, the more upstream the positions of the guide surfaces, the larger the angles of the guide surfaces with respect to the vertical direction. However, this is not limited thereto.

The guide surfaces may be configured such that, at least between two guide surfaces that are disposed adjacent to each other, the inclination, toward downstream in the transport direction, of one of the two guide surfaces (a first surface) that is on an upstream side is larger than that of another of the two surfaces (a second surface) that is on a downstream side in the transport direction. Also in this case, the developer that is removed from the developing roller on the upstream side and that is guided by the first surface is guided toward downstream by a distance larger than that of the developer that is removed from the developing roller on the upstream side and that is guided toward downstream by the second surface. Thus, the amount of developer that reaches the surface of the developer contained in the first container 311 is larger on the downstream side than on the upstream side, and unevenness in the amount of developer supplied to the photoconductor drum in a direction along the rotation axis of the photoconductor drum is reduced.

Tenth Modification

In the exemplary embodiments described above, the guide member guides the developer by using the guide surfaces or the magnetic members. However, this is not limited thereto, and a different member or device may guide the developer. For example, a blower that blows air to the removed developer in a diagonal direction between the vertically downward direction and the transport direction may be used, and the developer may be guided toward the downstream direction by airflow generated by the blower. In this case, the blower may be configured such that the amount of developer that reaches, from the developing roller 320, the first transport roller 330 on the upstream side of the blower is smaller than the amount of developer that reaches, from the developing roller 320, the first transport roller 330 on the downstream side of the blower. For example, the blower may generate stronger airflow to the upstream side than to the downstream side. Thus, the amount of developer that is guided from the upstream side toward the downstream direction is larger than the amount of developer that is guided from the downstream side toward the downstream direction, whereby unevenness in the amount of developer supplied to the photoconductor drum in the direction along the rotation axis of the photoconductor drum is reduced.

Eleventh Modification

In the exemplary embodiments described above, a tandem-type image forming apparatus is described as an example. However, this is not limited thereto, and a rotary-type image forming apparatus may be used. In the exemplary embodiments described above, the image forming apparatus forms a color image by using an intermediate transfer method. However, this is not limited thereto, and a color image may be formed by using a direct transfer method. Instead of a color image, a monochrome image may be formed. In any of these cases, the image forming apparatus according to the present modification may develop an electrostatic latent image formed on the photoconductor drum by using a device corresponding to the developing device 300.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a developer carrier that holds a developer on a surface thereof, rotates around a rotation axis, and supplies the developer to an image carrier at a facing portion at which the developer carrier faces the image carrier;

a transport member that transports the developer in a longitudinal direction of the transport member while supplying the developer to the surface of the developer carrier; and a guide member that includes a guide portion that guides, toward the transport member, the developer that was held on the surface of the developer carrier and that has passed the facing portion without being supplied to the image carrier, the guide member making an amount of the developer that reaches an upstream side of the transport member in the longitudinal direction be smaller than an amount of the developer that reaches a downstream side of the transport member in the longitudinal direction.

2. A developing device comprising:

a developer carrier that holds a developer on a surface thereof, rotates around a rotation axis, and supplies the developer to an image carrier at a facing portion at which the developer carrier faces the image carrier;

a transport member that transports the developer in a transport direction along the rotation axis of the developer carrier while supplying the developer to the surface of the developer carrier; and a guide member that has a plurality of surfaces that are arranged in the transport direction, the plurality of surfaces guiding, toward downstream in the transport direction, the developer that was held on the surface of the developer carrier and that has passed the facing portion without being supplied to the image carrier, the plurality of surfaces at least including a first surface and a second surface that are adjacent to each other, the first surface being disposed upstream of the second surface in the transport direction and having an inclination toward downstream in the transport direction that is larger than an inclination of the second surface toward downstream in the transport direction.

3. The developing device according to claim 2, wherein the guide member is configured such that the more upstream the positions of the plurality of surfaces in the transport direction, the larger the inclinations of the plurality of surfaces.

4. The developing device according to claim 2, wherein the plurality of surfaces are disposed on a plate-shaped member, and wherein the plate-shaped member includes a contact portion that contacts the surface of the developer carrier.

5. The developing device according to claim 2, wherein the plurality of surfaces include at least one surface that is curved toward downstream in the transport direction.

6. The developing device according to claim 2, further comprising:

a container that contains the developer;

a detector that detects an inclination of the developer in the container; and a changing unit that changes inclinations of the plurality of surfaces on the basis of the inclination of the developer detected by the detector.

7. A developing device comprising:

a developer carrier that holds a developer on a surface thereof, rotates around a rotation axis, and supplies the developer to an image carrier at a facing portion at which the developer carrier faces the image carrier;

a transport member that transports the developer in a transport direction along the rotation axis of the developer carrier while supplying the developer to the surface of the developer carrier; and a guide member including a magnetic member that guides, toward downstream in the transport direction by using a magnetic force, the developer that has been supplied from the transport member to the image carrier, that was held on the surface of the developer carrier, and that has passed the facing portion without being supplied to the image carrier.

8. The developing device according to claim 7, wherein the more upstream a position of the developer, the more stronger the magnetic force applied by the magnetic member to the developer.

9. The developing device according to claim 1, wherein the number of the developer carriers is two, and the two developer carriers are arranged in a vertical direction, and wherein the number of the guide members are two, and the two guide members guide, toward downstream in the longitudinal direction, the developer that has passed the facing portions at which the two developer carriers and the image carrier face each other.

10. An image forming apparatus comprising:

the developing device according to claim 1;

the image carrier;

a charger that charges the image carrier;

an image forming unit that includes an exposure device that exposes the image carrier charged by the charger to light and forms an electrostatic latent image, develops the electrostatic latent image formed on the image carrier by using the developer that is supplied from the developing device, and forms an image;

a transfer unit that transfers the image formed by the image forming unit to a recording medium; and a fixing unit that fixes the image transferred by the transfer unit.

* * * * *